United States Patent [19]

Hikosaka et al.

[11] Patent Number: 4,987,451

[45] Date of Patent: Jan. 22, 1991

[54] IMAGE FORMING APPARATUS

[75] Inventors: Akihiro Hikosaka; Hitoshi Sakai; Takayoshi Yoshihara; Naoichi Asakura, all of Osaka, Japan

[73] Assignee: Minolta Camera Kabushiki Kaisha, Osaka, Japan

[21] Appl. No.: 470,677

[22] Filed: Jan. 26, 1990

[30] Foreign Application Priority Data

Jan. 30, 1989 [JP] Japan ..... 1-21702

[51] Int. Cl.[5] ..... G03G 15/06; G03G 15/00

[52] U.S. Cl. ..... 355/245; 355/260

[58] Field of Search ..... 355/245, 269, 264, 260

[56] References Cited

U.S. PATENT DOCUMENTS 4,792,827 12/1988 Ogura ..... 355/207

FOREIGN PATENT DOCUMENTS 60-198571 10/1985 Japan .

*Primary Examiner*—A. T. Grimley

*Assistant Examiner*—Nestor R. Ramirez

*Attorney, Agent, or Firm*—Willian Brinks Olds Hofer Gilson & Lione

[57] ABSTRACT

The present invention discloses an image forming apparatus comprising an image forming unit attachable to the body of the image forming apparatus and having at least a developing device which has a toner receiving opening, a toner supply member attachable to the body of the image forming apparatus and having a toner supply opening opposed to the toner receiving opening at a predetermined position when the unit is attached to the body of the image forming apparatus for supplying toner to the developing device through the toner supply opening, a covering member for selectively covering the toner supply opening, a fixing member for fixing the unit to the body of the image forming apparatus, and a moving member disposed in the body of the image forming apparatus for moving the covering member so that the toner receiving opening is open when the unit is fixed to the body of the image forming apparatus by the fixing member. The apparatus also includes aspirator means for collecting spilled toner to reduce the likelihood that toner spilled from the developing device will be scattered about.

11 Claims, 4 Drawing Sheets

IMAGE FORMING APPARATUS

BACKGROUND OF THE INVENTION

1. Field of the Invention

The present invention relates to image forming apparatus which have an image forming unit removably attached to the body of the apparatus.

2. Description of the Prior Art

Image forming apparatus have already been proposed which comprise an image forming unit including a photosensitive drum, sensitizing charger and the like in addition to a developing device and removably installable in the body of the apparatus, and toner supply means provided in the apparatus body for the developing device and having a toner supply opening. With the image forming unit installed in the apparatus body, the toner supply opening is positioned above, and opposed to, a toner receiving opening of the developing device in communication therewith. The toner supply opening is opened or closed by moving a cover member in operative relation with the installation or removal of the image forming unit.

However, the proposed image forming apparatus has the problem that if the image forming unit is removed quickly, the toner supply opening moves away from the receiving opening before the supply opening is completely closed with the cover member, permitting some toner to fall from the supply opening to spill over the neighborhood to cause staining.

SUMMARY OF THE INVENTION

The main object of the present invention is to provide an image forming apparatus comprising an image forming unit which can be installed in the body of the apparatus smoothly and properly.

Another object of the invention is to provide an image forming apparatus which comprises an image forming unit having a developing device and removably attachable to the body of the apparatus and in which when the image forming unit is attached to the apparatus body, the developing device is adapted to receive toner reliably without spillage from toner supply means provided in the apparatus body.

These objects of the present invention are fulfilled by providing an image forming apparatus which comprises:

- an image forming unit removably attachable to the body of the apparatus and having at least a developing device formed with a first opening for receiving toner,
- means for supplying the toner to the developing device, the toner supplying means having a second opening opposed to the first opening for supplying the toner therethrough when the image forming unit is attached to the apparatus body,
- a cover member for selectively closing the second opening,
- means for fixing the image forming unit to the apparatus body, and
- means for moving the cover member so that the second opening is open when the image forming unit is fixed to the apparatus body by the fixing means.

These and other objects, advantages and features of the invention will become apparent from the following description thereof taken in conjunction with the accompanying drawings which illustrate a specific embodiment of the invention.

DESCRIPTION OF THE PREFERRED EMBODIMENT

An embodiment of the invention will be described below with reference to the accompanying drawings.

Brief Description of the Apparatus

Figure 1:
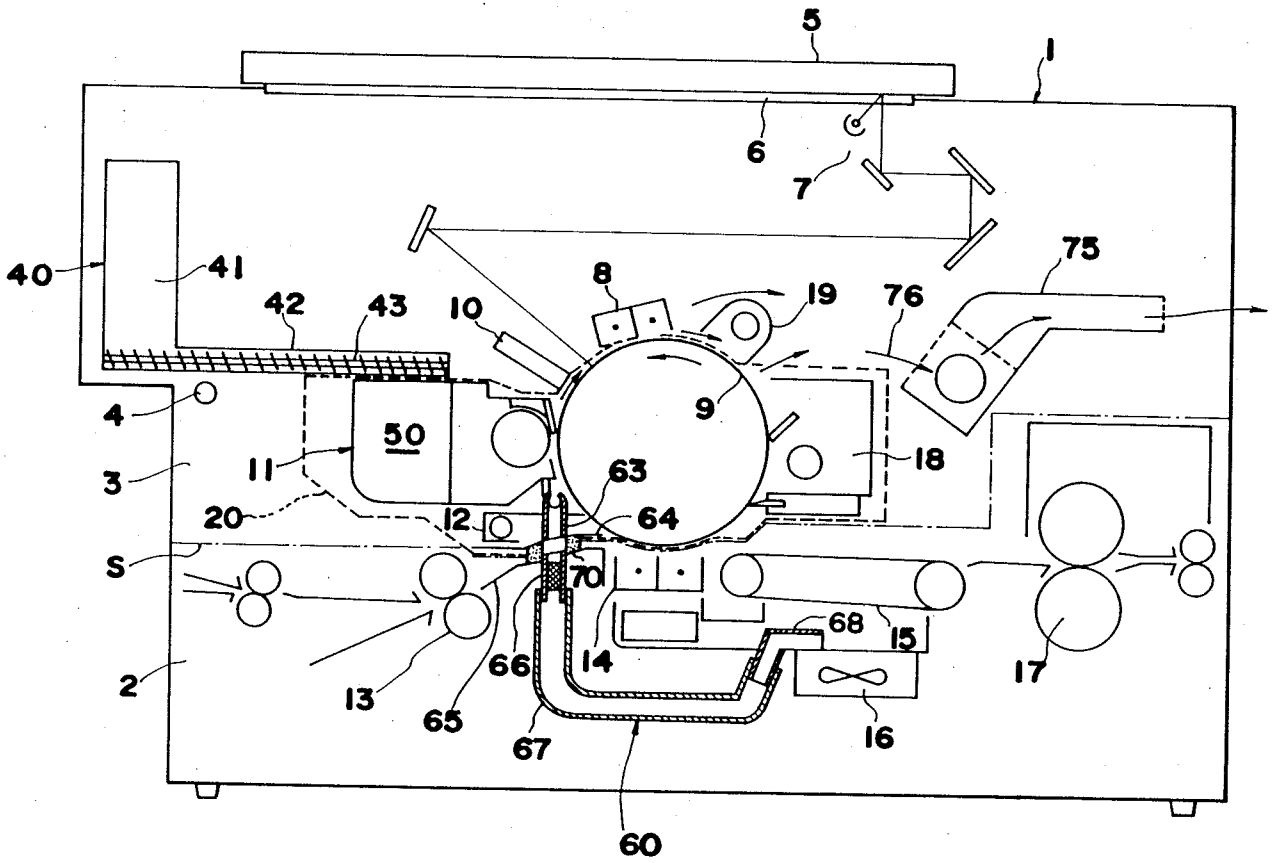
FIG. 1 is a view in section schematically showing an image forming apparatus of the invention.

FIG. 1 is a sectional view schematically showing an image forming apparatus embodying the invention.

With reference to the drawing, the body 1 of the apparatus is divided along a dot-and-dash line, i.e., along a boundary line S, into upper and lower two units, i.e., a lower unit 2 and an upper unit 3. The upper unit 3 can be opened as supported by a pivot 4. The body 1 is provided with an image forming unit 20 indicated in a broken line, toner supply means 40, and a toner aspirator 60.

Image Forming Operation

With the image forming apparatus described, images are formed by the following process.

A document placed on a document support glass plate 6 and covered with a cover 5 is illuminated with an optical system 7. The peripheral surface of a photosensitive drum 9 charged to a predetermined potential by a sensitizing charger 8 is exposed to the reflected light, whereby an electrostatic latent image is formed on the surface in corresponding relation to the document image.

The latent image moves in the direction of arrow shown with the rotation of the drum 9, has the charge removed from the opposite end portions of the image by a side eraser 10 and is converted to a visible toner image with charged toner electrostatically supplied to the drum surface from a developing device 11.

Copy paper is supplied by an unillustrated paper feeder and transported, as timed with the toner image by a timing roller 13, to the position opposed to a transfer charger 14, by which the toner image is transferred onto the paper.

While being held to the outer surface of a conveyor belt 15 by the suction of a fan 16, the paper bearing the toner image is transported to a fixing device 17, by which the toner image is thermally fixed to the paper. The copy thus obtained is delivered to an unillustrated paper tray.

On the other hand, the toner remaining on the surface of the drum 9 without being transferred to the paper is removed by a cleaner 18. The drum surface is further irradiated with light by an eraser 19 and has the residual charge removed therefrom in preparation for the subsequent image forming operation.

Image Forming Unit and Toner Supply Means

Figure 2:
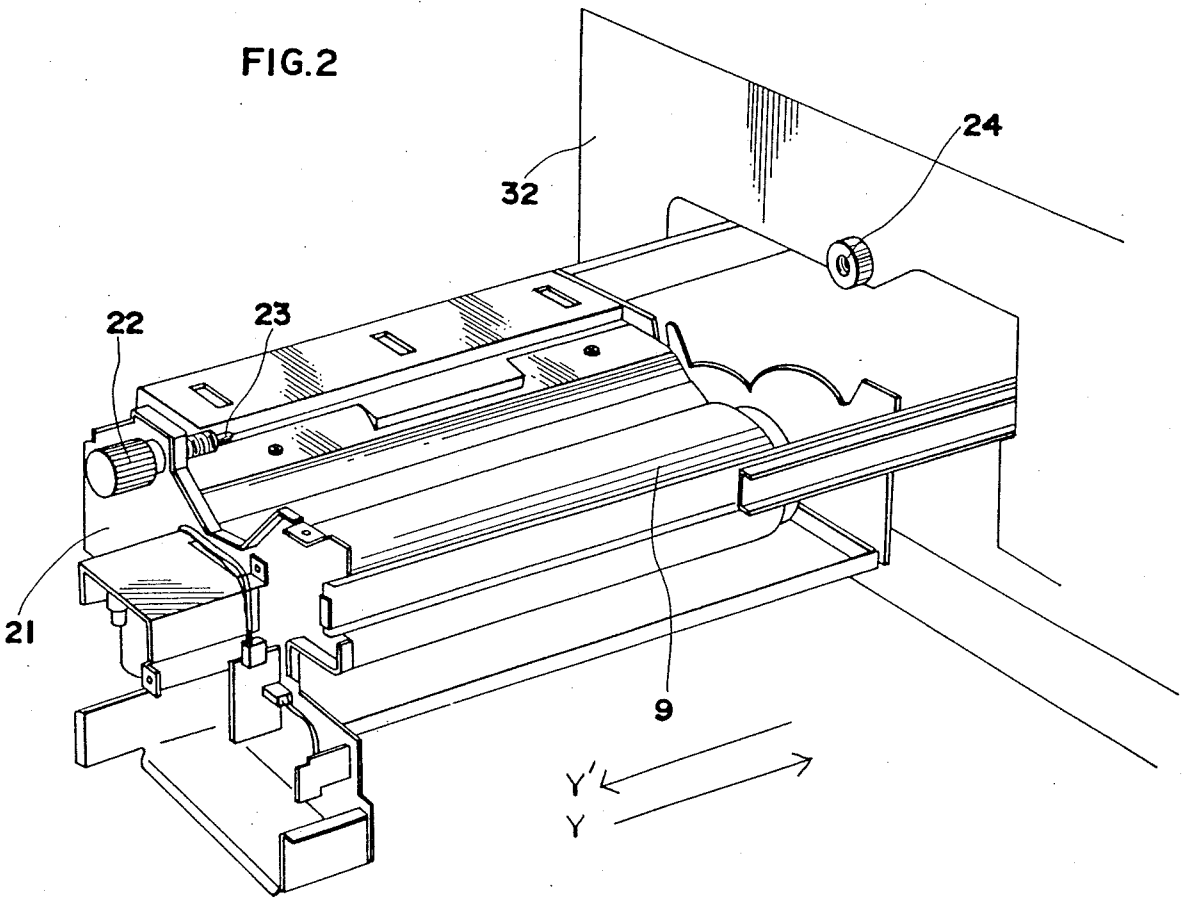
FIG. 2 is a perspective view showing an image forming unit as withdrawn from the body of the apparatus shown in FIG. 1.

The image forming unit 20 comprises the photosensitive drum 9, the developing device 11, the cleaner 18, etc. which are assembled together along with a unit frame 21 (see FIG. 2). The image forming unit 20 can be installed into the upper unit 3 by opening a front cover thereof (not shown) and pushing the unit 20 from the front side inward (in the direction of arrow Y). The unit 20 can be pulled out from the unit 3 toward the front side (in the direction of arrow Y'). The image forming unit 20 can be fixed to the apparatus body 1 by screwing a fastening screw 22 into a screw hole 24 formed in a front wall 32 of the opening mechanism 30 to be described below, as shown in FIG. 2. A toner replenishing chamber 50 (see FIG. 1) positioned in the rear portion of the developing device 11 is formed in its ceiling portion with an opening 51 (see FIG. 3) for receiving the toner therethrough from the toner supply means 40.

Figure 3:
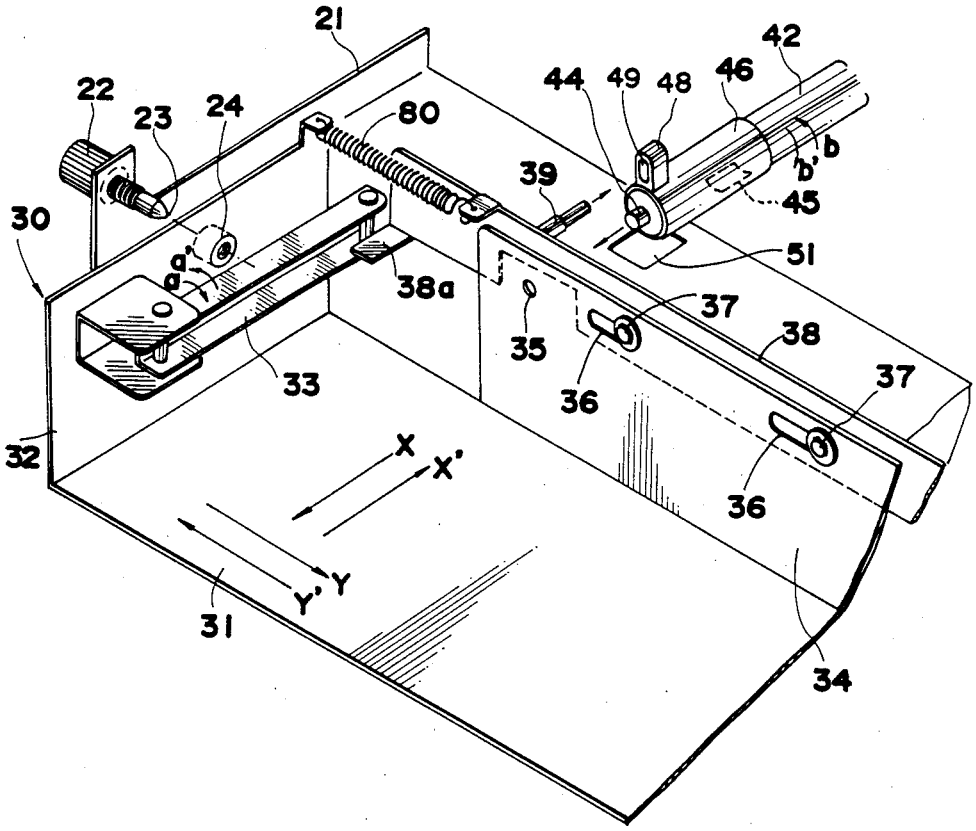
FIG. 3 is a perspective view showing an opening mechanism for a cover provided on a toner transport duct.

The opening mechanism 30 shown in FIG. 3 has a lever 33 pivotally movably supported by the front wall 32 of a frame 31 fixed to the body 1. The frame 31 has a side wall 34 intersecting the front wall 32 at a right angle therewith. A slide plate 38 is supported by pins 37, 37 engaged in slots 36, 36 which are formed in the side wall and extend in the direction of arrows Y, Y'. The slide plate 38 is biased toward the front wall 32 by a spring 80 attached at its one end to the front wall 32 and has a stopper 38*a* in pressing contact with the free end of the lever 33, whereby the slide plate 38 is positioned in place.

As shown in FIG. 1, the toner supply means 40 comprises a toner transport duct 42 in the form of a hollow cylinder and extending from the bottom portion of a hopper 41 toward the developing device 11. A conveyor screw 43 is disposed inside the transport duct 42 and the hopper 41. The duct 42 is formed with a toner supply opening 45 in its wall on the lower side of the forward end portion thereof and has a projection 44 on its forward end face.

A hollow cylindrical cover 46 having an opening 47 (see FIG. 4) is fitted around the forward end portion of the toner transport duct 42. The cover 46 is biased in the direction of arrow b shown by an unillustrated spring to close the toner supply opening 45 and thereby prevent the toner from falling from the opening 45. The cover 46 is provided on an outer peripheral portion thereof with a projection 48 having an aperture 49.

When the image forming unit 20 has not been installed in place, the toner supply means 40 thus constructed is placed into the upper unit 3 in the direction of arrow X, the projection 44 on the forward end of the toner transport duct 42 is fitted into a hole 35 formed in the side wall 34 of the opening mechanism 30, a pin 39 provided on the slide plate 38 is inserted into the aperture 49 of the projection 48 on the cover 46, and the supply means 40 is fixed to the upper unit 3.

Since the image forming unit 20 has not been installed in place at this time, the slide plate 38 has been moved toward the direction of arrow Y' by being biased by the spring 80.

Next, the image forming unit 20 is placed into the upper unit 3 in the direction of arrow Y, whereby the toner receiving opening 51 of the developing device 11 is opposed to the toner supply opening 45 of the toner transport duct 42. However, with the toner supply opening 45 closed with the cover 46, no toner will fall from the toner transport duct 42.

Subsequently, the fastening screw 22 is driven into the screw hole 24. When the screw 22 as fitted in the screw hole 24 is rotated one to two turns, the forward end 23 of the screw 22 comes into contact with the lever 33. As the screw 22 is further rotated, the lever 33 pivotally moves in the direction of arrow a. This movement causes the stopper 38*a* to move the slide plate 38 in the direction of arrow Y and causes the pin 39 to rotate the cover 46 in the direction of arrow b', bringing the opening 47 of the cover 46 into register with the toner supply opening 45 of the toner transport duct 42, whereby the toner supply opening 45 is brought into communication with the toner receiving opening 51 of the developing device 11.

Accordingly, when the conveyor screw 43 of the toner supply means 40 is rotated, the toner in the hopper 41 is transported toward the forward end of the toner transport duct 42, passed through the toner supply opening 45 and then through the toner receiving opening 51 and supplied to the toner replenishing portion 50 of the developing device 11.

Figure 4:
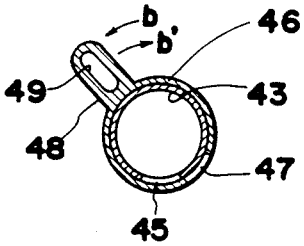
FIG. 4 is a sectional view showing the forward end of the toner transport duct.

On the other hand, when the image forming unit 20 is to be withdrawn from the body 1, the fastening screw 22 is rotated for loosening. As the screw 22 is rotated at this time, the lever 33 moves in the direction of arrow a' and the slide plate 38 moves in the direction of arrow Y' under the action of the spring 80. With the toner supply means 40, this movement rotates the cover 46 in the direction of arrow b to close the toner supply opening 45 of the toner transport duct 42 as seen in FIG. 4. Consequently, the image forming unit 20 can be pulled out in the direction of arrow Y' without the likelihood of the toner falling from the transport duct 42.

Toner Aspirator

Figure 5:
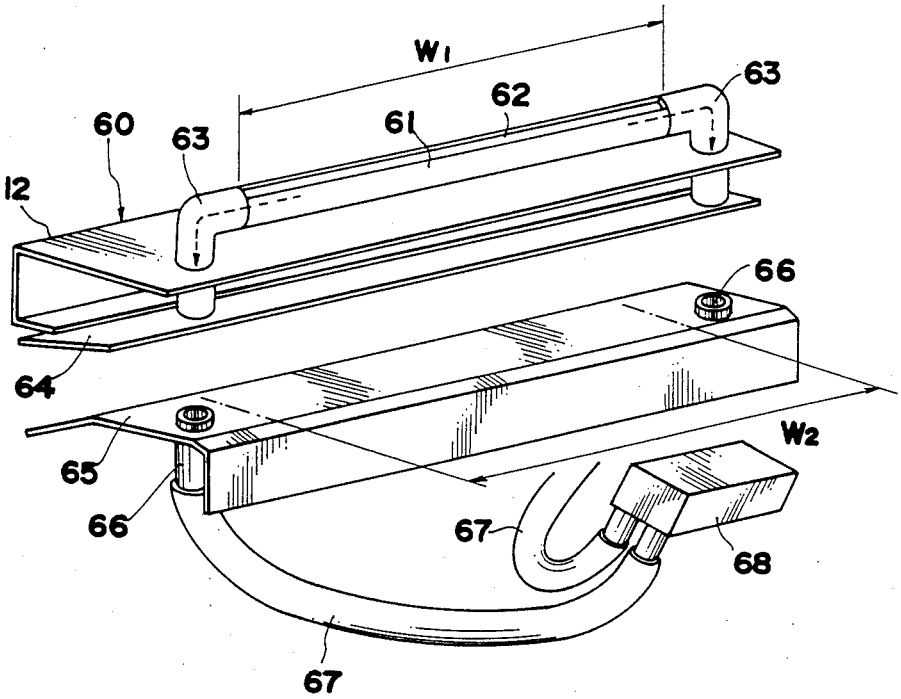
FIG. 5 is a perspective view of a toner aspirator.

With reference to FIG. 5, the toner aspirator 60 has a particle aspirator pipe 61 which is formed with a suction opening 62 in the form of a slit and extending axially of the pipe. As seen in FIG. 1, the pipe 61 is disposed immediately below the position where the developing device 11 is opposed to the photosensitive drum 9.

Pipes 63, 63 are joined each at its one end to the respective ends of the aspirator pipe 61 and have the other ends extending through the frame of a pretransfer eraser 12 and an upper guide plate 64 on the upper unit 3 and fixed in place. The length $W_1$ of the suction opening 62 of the aspirator pipe 61 is larger than the width of image forming area of the drum 9, and the suction opening 62 is so positioned that the length thereof covers or includes the width.

Pipes 66, 66 are each internally provided with a filter material 71 and are attached to a lower guide plate 65 of the lower unit 2 in opposed relation with the respective pipes 63, 63. The upper and lower guide plates 64, 65 define the path of transport of the paper. The pipes 66 are arranged outside the path and spaced apart from each other by a distance not smaller than the width $W_2$ of the path so as not to position across the path. Hoses 67, 67 are joined each at its one end to the respective pipes 66, 66 and are connected at the other ends thereof to a duct 68 provided at one side portion of the suction fan 16.

Figure 6:
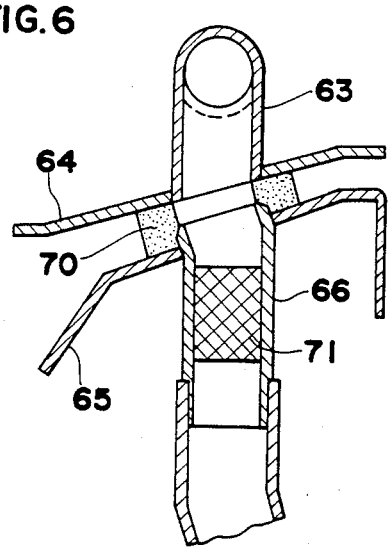
FIG. 6 is a fragmentary view in section of the toner aspirator.

Since the upper guide plate 64 moves away from the lower guide plate 65 when the upper unit 3 is opened, it is impossible to fixedly connect the pipes 63, 66 together. As seen in FIG. 6, therefore, a tubular seal member 70 surrounding each pipe 66 is provided on the lower guide plate 65. The pipes 63 and 66 communicate with each other through the seal member 70 when the upper unit 3 is closed but can be separated from each other when the upper unit 3 is opened.

With the toner aspirator 60 thus constructed, air is aspirated through the pipes 63, 66, the hoses 67 and the duct 68 by the suction of the fan 16.

Furthermore, the toner falling from the position where the developing device 11 is opposed to the drum 9 is aspirated through the suction opening 62 of the particle aspirator pipe 61 for collection. The toner aspirated through the aspirator pipe 61 is led through the pipes 63 and the seal members 70 into the pipe 66, in which the toner is collected by the filter material 71.

The aspirator 60 therefore reduces the likelihood that the toner spilled from the developing device 11 will scatter about, resulting in diminished staining. The spilled toner is further likely to diffuse as entrained in an air current 76 produced by a fan 75 (see FIG. 1) for collecting the ozone generated by the discharge of the sensitizing charger 8 and the like and becomes deposited on the charging wire, net or the like of the charger 8, whereas the aspirator obviates this drawback to give a stabilized charge potential to the photosensitive drum 9.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a unit attachable to the body of the image forming apparatus and including image forming means, said unit having at least a developing device which has a toner receiving opening;

toner supply means for supplying toner to said developing device through a toner supply opening thereof, said toner supply opening being opposed to said toner receiving opening at a predetermined position when said unit is attached to the body of the image forming apparatus;

a covering member for selectively covering the toner supply opening;

fastening means for fastening said unit on the body of the image forming apparatus; and moving means disposed in the body of the image forming apparatus for moving said covering member so that the toner receiving opening is open when said unit is fastened on the body of the image forming apparatus by said fastening means.

2. An image forming apparatus as claimed in claim 1 wherein said moving means includes a lever pivotally movable in conjunction with the fastening of the unit on the body by the fastening means, a sliding member slidable by the pivotal movement of said lever, a projecting member movably arranged on said sliding member for connecting the covering member to the sliding member, said projecting member being movable while connecting the covering member to the sliding member when the sliding member is slid by the rotation of the lever in conjunction with the fastening of the unit by the fastening means, so that the covering member is retracted from the toner supply opening.

3. An image forming apparatus comprising:

an image forming unit attachable to the body of the image forming apparatus and having at least a developing device provided with a toner receiving opening, said unit being attachable to the body of the image forming apparatus in a first state and being detachable from the body thereof in a second state;

toner supply means for supplying toner to said developing device through a toner supply opening thereof, said toner supply opening being opposed to said toner receiving opening at a predetermined position when said image forming unit is in said first state;

a covering member for selectively covering the toner supply opening, said covering member being movable between a first position wherein the covering member covers the toner supply opening and a second position wherein the covering member is retracted from the toner supply opening;

fastening means for fastening said on the body of the image forming apparatus; and moving means disposed in the body of the image forming apparatus for moving said covering member from said first position to said second position in conjunction with the fastening of the unit on the body of the image forming apparatus by said fastening means.

4. An image forming apparatus as claimed in claim 3 wherein said toner supply means has a toner transport channel arranged between said toner supply means and the developing device and having said toner supply opening, and toner transport means arranged in said toner transport channel for transporting toner received from the toner supply means and supplying the toner from the toner supply opening to the toner receiving opening of the developing device.

5. An image forming apparatus as claimed in claim 3 wherein said moving means includes a lever rotatable in conjunction with the fastening of the unit on the body by the fastening means, a sliding member slidable by the pivotal movement of said lever, and a projecting member movably arranged on said sliding member for connecting the covering member to the sliding member, said projecting member being movable while connecting the covering member to the sliding member when the sliding member is slid by the rotation of the lever in conjunction with the fastening of the unit on the body by the fastening means, so that the covering member is moved from the first position to the second position.

6. An image forming apparatus comprising:

an image forming unit attachable to the body of the image forming apparatus and having at least a developing device provided with a toner receiving opening, said unit being positionable in a first state wherein said unit is attached to a body of the image forming apparatus or in a second state wherein the unit is retracted from the body thereof;

toner supplying means for supplying toner to said developing device;

a toner transport channel connected to said toner supply means and having a toner supply opening, said toner supply opening being opposed to said toner receiving opening at a predetermined position when the unit is in said first state;

toner transport means disposed in said toner transport channel for transporting toner received from said toner supply means and supplying the toner from said toner supply opening to the toner receiving opening of the developing device;

a covering member for selectively covering the toner supply opening, said covering member being movable between a first position wherein the covering member covers the toner supply opening and a second position wherein the covering member is retracted from the toner supply opening;

fastening means for fastening the unit on the body of the image forming apparatus; and moving means disposed in the body of the image forming apparatus for moving said covering member between said first position and said second position, said moving means being operable in relation with fastening and release of said unit by said fastening means.

7. An image forming apparatus as claimed in claim 6 wherein said unit further includes a photosensitive member for forming an electrostatic latent image thereon and a cleaning device for cleaning the surface of the photosensitive member.

8. An image forming apparatus as claimed in claim 6 wherein said moving means includes a lever rotatable in conjunction with the fastening of the unit on the body by the fastening means, a sliding member slidable by the pivotal movement of said lever, and a projecting member movably arranged on said sliding member for connecting the covering member to the sliding member, said projecting member being movable while connecting the covering member to the sliding member when the sliding member is slid by the rotation of the lever in conjunction with the fastening of the unit by the fastening means, so that the covering member is moved from the first position to the second position.

9. An image forming apparats as claimed in claim 6 which further comprises toner aspirator means for aspirating the toner by the suction of a fan for attracting a transfer sheet to a transport belt during the transport of the sheet to toner fixing means.

10. In an image forming apparatus comprising a unit attachable to the body of the image forming apparatus and including image forming means, which has at least a developing device having a toner receiving opening, a toner supply means having a toner supply opening for supplying toner from said toner supply opening to said toner receiving opening of said developing device, said toner supply opening being opposed to the toner receiving opening at a predetermined position when the unit is attached to the body, a covering member for covering said toner supply opening, and a fastening means for fastening said unit on the body of the image forming apparatus, a method for attaching the unit to the body of the image forming apparatus comprising the steps of:

sliding the unit into the body of the image forming apparatus;

fastening the unit on the body by said fastening means; and retracting the covering member from the toner supply opening of the toner supply means in conjunction with fastening of the unit on the body by the fastening means.

11. A method as claimed in claim 10 which further comprises the step of:

transporting the toner to the developing device through the toner receiving opening thereof after retracting the covering member from the toner supply opening of the toner supply means.

* * * * *